US005106059A

United States Patent [19]

Knott et al.

[11] Patent Number: 5,106,059

[45] Date of Patent: Apr. 21, 1992

[54] SIPHON DRIVEN QUENCH TANK ASSEMBLY

[75] Inventors: Henry J. Knott, Southfield, Mich.; Terrance L. McKinniss, Gallipolis, Ohio; Gene A. Williams, Point Pleasant, W. Va.

[73] Assignee: Federal-Mogul Corporation, Southfield, Mich.

[21] Appl. No.: 502,703

[22] Filed: Apr. 2, 1990

[51] Int. Cl.[5] ..... C21D 1/62

[52] U.S. Cl. ..... 266/114; 266/259; 148/157

[58] Field of Search ..... 266/114, 259; 148/157, 148/143, 144; 118/602

[56] References Cited

U.S. PATENT DOCUMENTS 2,166,250 7/1939 Herman .

3,684,263 8/1972 Genrich ..... 266/132

FOREIGN PATENT DOCUMENTS 999377 7/1965 United Kingdom ..... 266/259

*Primary Examiner*—R. Dean

*Assistant Examiner*—Margery S. Phipps

*Attorney, Agent, or Firm*—Lawrence J. Shurupoff

[57] ABSTRACT

A quench tank includes a reservoir located within a sump tank. Heated steel parts are dropped through a vertical tube in which a quenching liquid is flowing upwardly from the sump tank and into the reservoir under hydrostatic-induced pressure. Turbulent flow of liquid across the surfaces of the steel parts produces a rapid cooling and quenching action. The liquid upflow is produced by a hydrostatic liquid head communicating with the lower end of the tube. The flow rate of the liquid, measured across the transverse cross section of the tube, is relatively constant, such that the quenching action is relatively uniform across a given part and from one part to another part.

11 Claims, 3 Drawing Sheets

SIPHON DRIVEN QUENCH TANK ASSEMBLY

BACKGROUND OF THE INVENTION

1. Field of the Invention

This invention relates to an apparatus and process for quenching heated steel parts.

2. Description of Prior Developments

The properties of steel parts can sometimes be improved by rapidly cooling such parts from a relatively high temperature, e.g. above about 1500° F., down to a relatively low temperature, e.g. approximately 200° F. By carrying out the cooling process in a relatively short time period, e.g. about one or two seconds, the steel is metallurgically transformed into a relatively hard condition, useful for many product applications. This rapid cooling process is usually termed quenching.

In many cases the quenching process is performed by plunging the steel part into a bath of relatively cool liquid. A bath temperature of around 80° F. is common. The quenching liquid can be any liquid that effectively removes heat from the steel part such as water, a sodium chloride brine solution, or oil.

The quenching (cooling) process should be performed at a relatively fast rate. However, if the cooling is too rapid or uneven the part may undergo thermal distortion due to the fact that some areas of the part are momentarily in contraction while other areas are not. This could lead to cracking of the part. The problem is somewhat complicated by the fact that the cooling rate is affected by the turbulence or non-turbulence of the liquid at the part-liquid interface.

It is known that the heat exchange rate can be appreciably increased by causing the liquid to be in a turbulent state. The turbulent liquid exerts a scrubbing action on the part, which disturbs and replaces the film on the surface of the part, such that the disturbed liquid is enabled to remove heat from the part and provide new cool liquid on the part surface.

In order to promote heat transfer between the liquid and the part as it is being plunged into the coolant bath, it has been proposed to move the coolant upwardly around and across the part, preferably in a turbulent flow. In one known arrangement the heated part is dropped into a vertical flow tube containing a quenching liquid (oil). A pump is provided for moving the liquid upwardly through the tube. The downwardly-moving part makes thermal contact with the upwardly-moving liquid, such that some turbulence is created at the interface between the liquid and the contacting surface of the part.

U.S. Pat. No. 3,684,263 to Genrich discloses a quench tank of the above-mentioned type wherein an upward flow of cooling liquid is generated by a motor-operated pump. In experimentation with quenching systems wherein the liquid is pumped upwardly through a vertical flow tube, it was discovered that the linear flow rate is often not uniform across the tube cross section. In one system studied, the linear flow rate varied from a low value of about 1.6 feet per second to a high of about 3.0 fee per second in a given cross section. The variation is at least partly attributable to the fact that the liquid enters the tube through a side opening in the tube wall and has a lateral motion component that is never fully eliminated.

The non-uniform liquid flow through the tube produces variations in the turbulence at different sections of the downwardly-moving part. The part surface areas making contact with the fastest (most turbulent) liquid tend to be cooled at a more rapid rate than the other surface areas. There tends to be a degree of thermal distortion in the part, and also an undesired variation in the hardness of the part, from one area of the part to another. There also tends to be some hardness variations from one part to another part.

SUMMARY OF THE INVENTION

The present invention contemplates the use of a hydrostatic liquid head (column) to produce a fluid flow upwardly through a flow tube. The liquid head exerts a uniform force on the liquid coolant directly below the lower end of a substantially vertical flow tube, such that the liquid flows substantially uniformly upwardly through the tube. The flow rate is substantially the same across the tube cross section except for an outer annular zone along the tube wall. By providing a substantially uniform turbulent flow rate across the tube cross section it is believed that a better, i.e. more uniform, control of the liquid turbulence is attained and hence better control of the cooling rate. This results in more uniform properties in the quenched parts.

The use of a hydrostatic liquid head for creating a liquid pumping action is also believed to be advantageous in adjusting or varying the absolute value of the liquid flow rate. A net hydrostatic head of five inches can provide a liquid flow rate of approximately 4.5 feet per second through an eight inch diameter flow tube. By reducing the net hydrostatic head to about three inches the linear flow rate can be reduced to about 3.5 feet per second. The correlation between hydrostatic head and flow rate is relatively good (reproducable), such that when the system is adjusted to a particular hydrostatic head setting one can be assured of achieving a particular flow rate without surges or variations.

In the proposed system a motor-operated pump is used to circulate quenched liquid such as oil. This liquid may be directed through an external filter and heat exchanger to keep the oil clean and within a suitable quenching temperature range. However, the pump is used only as an external circulation device, not as a device for pumping liquid upwardly through the quench tube. Upflow of liquid through the tube is achieved solely by the hydrostatic head in the tank that contains the vertical quench tube.

The vertical quench tube is located so that tank liquid entirely surrounds the lower end portion of the tube. The liquid can approach the lower open end of the tube from all radial directions, such that there are no unbalanced lateral forces tending to produce flow non-uniformities across the tube cross section.

THE DRAWINGS

DETAILED DESCRIPTION OF THE PREFERRED EMBODIMENTS

Figure 1:
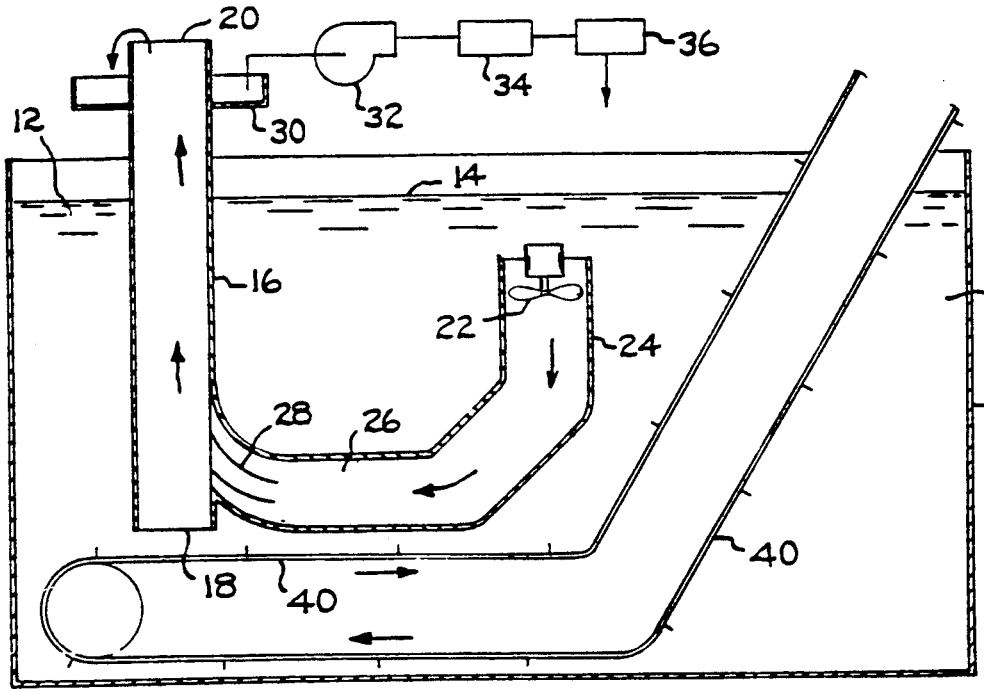
FIG. 1 PRIOR ART
FIG. 1 is a sectional view through a quenching apparatus constructed according to the teachings of the prior art.

Referring to FIG. 1, there is shown an upright sump tank 10 adapted to contain a liquid quenching medium 12 according to the prior art. Numeral 14 designates the upper surface of the liquid, i.e. the liquid level. Located within the tank is an upright stationary tube 16 having an open lower end 18 and an open upper end 20. Tube 16 may be supported in the tank by means of horizontal frame elements (not shown) extending horizontally from the tank side walls.

A motor-operated pump 22 is arranged within a vertical pipe 24 for pumping liquid from tank 10 downwardly through pipe 24 and into a horizontal pipe 26. The downstream end of pipe 26 includes an upturned section that joins the vertical tube 16. Guide vanes 28 are arranged in the downstream end of pipe 26 in an effort to achieve a fairly uniform flow velocity in tube 16.

The action of pump 22 causes the quenching liquid (oil) to flow from pipe 26 upwardly through tube 16. The liquid exits through the tube upper end 20 and overflows around the edge of the tube into an overflow chamber or tray 30. A motor-operated pump 32 conveys the liquid from chamber 30 through an external filter 34 and heat exchanger (cooler) 36. The cooled liquid is then returned to tank 10.

Heated steel parts or workpieces are dropped through tube 16 from a point above tube end 20, such that the steel parts have direct contact with the liquid flowing upwardly through the tube. During their downward passage through tube 16 the steel parts are cooled from a relatively high temperature, e.g. above 1400° F., to a relatively low temperature of approximately 100° F. The steel parts are deposited onto a chain conveyor 40, which transports them out of tank 10. Of course, other known methods of removing the parts may be used instead of the conveyor.

Tube 16 can have a vertical length of about four or five feet, and a transverse dimension of about eight inches. Pump 22 is operated so that the absolute linear velocity of the liquid in tube 16 is about two feet per second. The variables are optimized so that the steel part experiences a temperature drop of at least 1000° F. in less than two seconds. The quenching cooling action is substantially complete before the steel part reaches conveyor 40.

One disadvantage of the FIG. 1 system is the fact that the liquid velocity in the left half of tube 16 tends to be higher than the velocity in the right half of the tube. This is believed to be due to the fact that vanes 28 are not effective to fully turn the liquid from a horizontal trajectory into a vertical trajectory. Even after the liquid has entered into tube 15, it still will have a leftward motion component, such that the linear velocity in the left half of tube 16 is higher than the linear velocity in the right half of the tube. Moreover, liquid vortices are generated at the tips of the vanes 28. These vortices travel up the tube 16 in an unpredictable and nonuniform manner thereby exacerbating the problem of maintaining a uniform flow through the tube.

The flow non-uniformities produce different degrees of turbulence at the interfaces between the liquid and heated steel parts, depending on the location of the particular part relative to the tube 16 axis. Also, it is believed that the flow velocity gradient will tend to deflect the steel parts laterally toward the slower moving liquid, which is less turbulent and hence less effective for heat-removal purposes.

Figure 2:
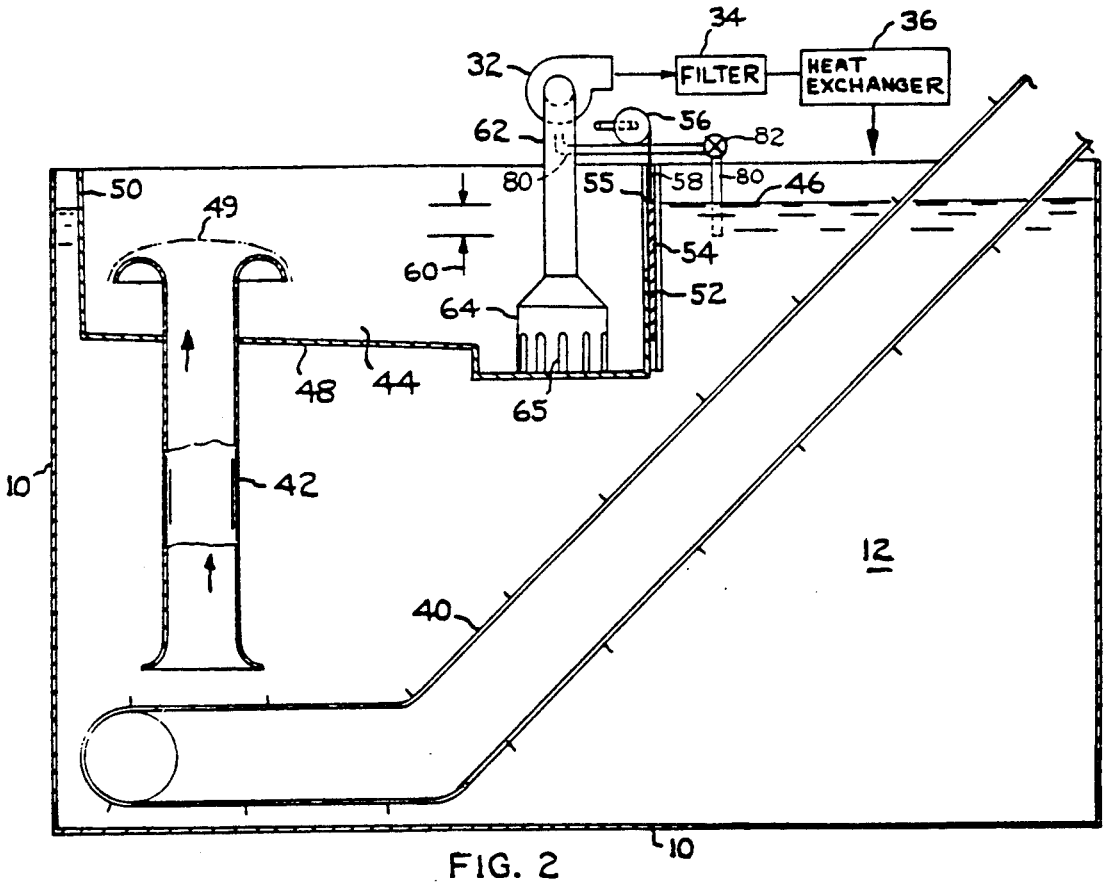
FIG. 2 is a view taken in the same direction as FIG. 1, but showing an apparatus constructed according to the present invention.

FIG. 2 illustrates an apparatus according to the present invention which has been designed to overcome difficiencies of the apparatus shown in FIG. 1. In this case the vertical flow tube 42 is arranged so that its upper end is located within an overflow chamber or reservoir 44 located partially below the tank liquid level 46. The lower end of tube 42 is located within tank 10 below reservoir 44 and forms a sole entry port for admitting quenching fluid into tube 42.

Reservoir 44 is defined by a floor 48, left end wall 50, and a right end wall 52. Wall 52 serves as a vertical partition to separate reservoir 44 from the tank liquid (oil) 12. A vertically adjustable wall member 54 is slidably supported in slots in the side walls of tank 10, whereby member 54 can be adjusted vertically while still acting as a barrier against liquid flow from tank 10 into reservoir 44. The upper edge 55 of the wall member 54 acts as a weir to establish and maintain the liquid level 46 in tank 12. This arrangement provides for an adjustment of liquid head differential 60, discussed below. Liquid overflow is from the tank into reservoir 44.

Any suitable mechanism can be used to adjust the position of wall member 54, if it is desired to have the adjustability feature. FIG. 2 schematically shows a hand crank and reel 56, on which is wound a cable 58. One end of the cable is attached to wall 54, such that operation of the hand crank raises or lowers wall member 54, to thereby adjust the elevation of weir edge 55. A brake or latch mechanism can be associated with crank 56 to hold the crank in different adjusted conditions.

The upper end of tube 42 is located below the sump (tank) liquid level 46, such that a hydrostatic liquid head is established for producing an upflow of liquid through tube 42. The upflow is produced solely by the height difference between liquid level 46 and the upper end of tube 42.

The dashed line 49 in FIG. 2 represents the profile configuration of the liquid body as it exits from the upper end of tube 42. The liquid overflows the upper edge of the tube evenly in all radial directions. Numeral 60 in FIG. 2 represents the liquid head differential between the liquid in sump tank 10 and the liquid in tube 42. The tube 42 liquid measurement is taken across the highest crown area 49 of the liquid waterfall generated at the upper end of tube 42.

Liquid head 60 is the driving force that produces the liquid upflow in tube 42. With a tube 42 length of about four feet and a circular tube diameter of about eight inches, a liquid head 60 of three inches produces a linear flow rate in tube 42 of about 3.5 feet per second. Increasing the liquid head 60 to five inches increases the linear flow rate in tube 42 to about 4.5 feet per second. Liquid head 60 is adjusted (up or down) by raising or lowering partition wall member 54.

Overflow liquid in reservoir 44 is recirculated back to tank 12 by a pump 32. The pump intake can include a vertical pipe 62 extending upwardly from a cylindrical housing 64. Vertical slots 65 are milled or otherwise formed in the lower peripheral edge of housing 64 for admitting the quenching liquid into housing 64. Pump 32 draws the liquid out of reservoir 44, and pumps the liquid through a filter 34 and cooler 36. The cleaned and cooled liquid is returned to tank 12, as indicated in FIG. 2. If desired, the amount of liquid drawn from reservoir 44 through pump 32 can be varied by simultaneously drawing liquid from sump tank 10 through pipe 80. A valve 82 may selectively vary the flow through pipe 80 and correspondingly (inversely) vary the flow through pipe 62.

Operation of the FIG. 2 quenching system involves dropping the heated steel parts into tube 42. The upflowing liquid in tube 42 makes turbulent contact with the steel surfaces for rapid removal of heat from the parts. Heat removed from the steel parts is contained in the liquid discharged from tube 42 into reservoir 44. The heat is subsequently removed from the quenching liquid as it flows through a cooler 36. The temperature of the liquid in tank 10 is maintained at approximately 140° F., such that the liquid flowing upwardly through tube 42 has a sufficient temperature differential relative to the heated steel parts so as to achieve a sufficiently rapid quenching and cooling action.

The lower end portion of tube 42 flares outwardly and downwardly in a curved bell-shaped configuration to achieve a somewhat gradual acceleration of the liquid as it is transformed from an essentially stagnant condition directly below the tube lower end to a flowing condition within tube 42. The flow velocity is inversely related to the flow cross-section. At the extreme lower edge of tube 42 the transverse cross-section is relatively large so that the linear flow rate is low. As the tube flares radially inwardly toward the tube axis the flow cross section lessens, so as to accelerate the liquid. By gradually increasing the flow rate at the entrance end of the tube it is believed that the tube will cause less flow instabilities and cavitation effects at the tube lower edge.

A major advantage of the FIG. 2 arrangement is the fact that the liquid flows into the tube uniformly from all points around and along the tube circumference. The upward flow rate within the main portion of the tube is uniform when measured at different points across the transverse cross section of the tube. The upper end portion of tube 42 flares radially outwardly and upwardly, such that the liquid is gradually decelerated as it approaches the extreme upper edge of the tube. The deceleration process is essentially the reverse of the acceleration process that takes place at the lower end of tube 42.

Deceleration of the liquid at the tube upper end is chiefly for the purpose of stabilizing the height of the waterfall "crown" area 49. With such a stabilized condition the liquid head differential 60 will be relatively constant for a given height of weir 55. This tends to keep the flow rate in tube 42 relatively constant without momentary surges or slow downs.

A relatively low flow velocity in the crown area 49 may also be advantageous in avoiding undesired lateral deflection of steel parts as they impinge on the liquid surface. Each steel part is subjected to approximately the same liquid force, such that overall cooling action in tube 42 is approximately uniform from one part to another.

Pump 32 may have a higher volumetric flow rate than tube 42, in which case pump 32 might be operated on an intermittent basis. Pump 32 could be run continuously or it could be controlled by a float switch responsive to liquid levels in reservoir 44, such that reservoir 44 always has a liquid level below the upper end of tube 42. The flow capacity or action of pump 32 will not vary the liquid level 46 in tank 10, partly because any excess liquid discharged from cooler 36 into the tank will merely overflow weir 55 back into reservoir 44.

The tank 10 area in top plan view is significantly greater than the cross sectional area of tube 42. This is advantageous in that the quantity of liquid being recirculated from cooler 36 into tank 10 then has negligible effect on liquid level 46. That level, established by weir 55, will remain essentially constant even though tube 42 might momentarily be flowing more or less liquid than is then being recirculated from cooler 36 back into the tank. The system is substantially self-correcting, such that the tube 42 flow rate is substantially constant for any given setting of weir 55.

For any given quenching or heat treating operation, partition 54 will assume a fixed position. However, for different work pieces it may be desirable to increase or decrease the liquid flow rate through tube 42. Partition 54 will be moved vertically to change the tube 42 flow rate.

Figure 3:
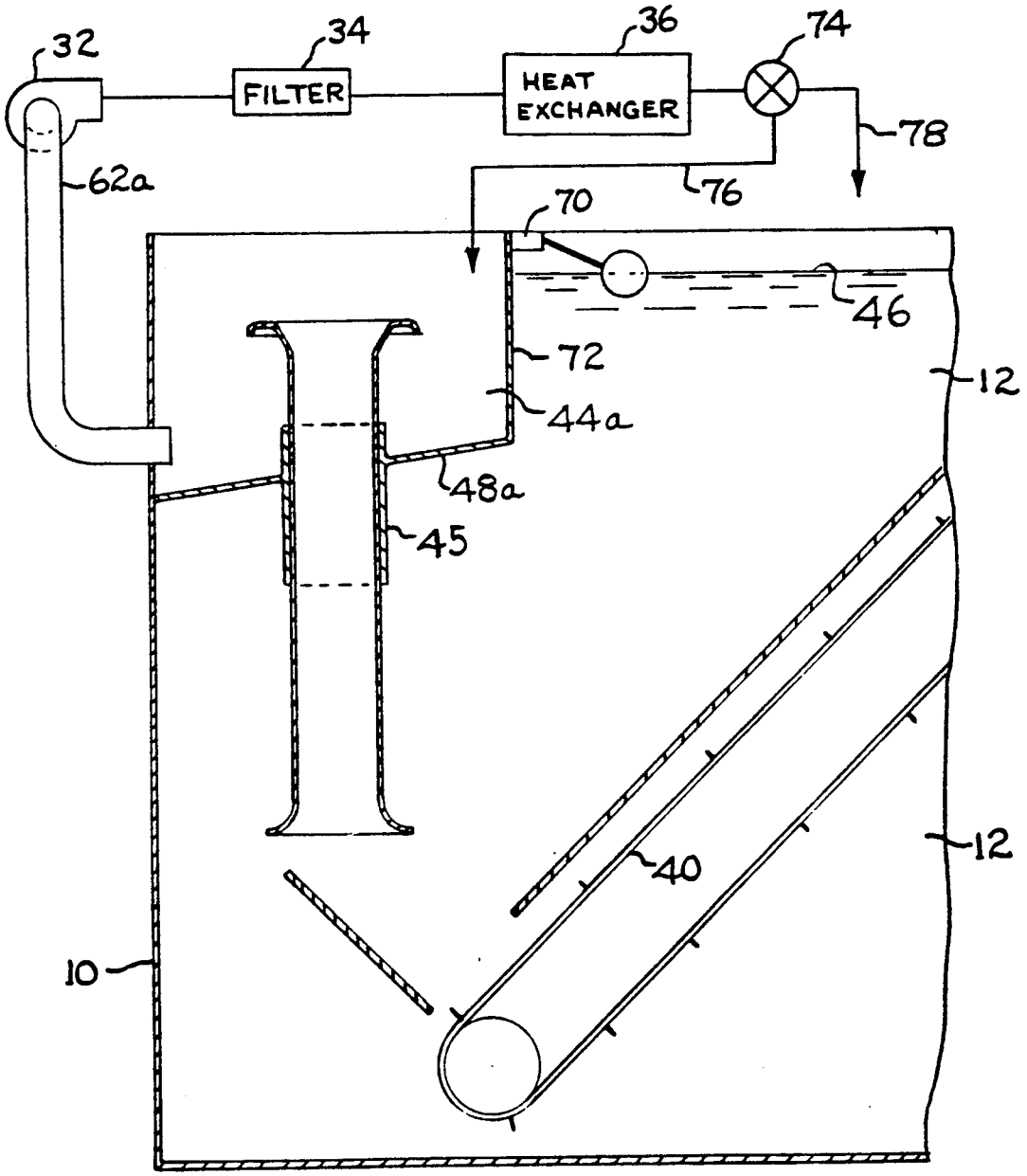
FIG. 3 is a sectional view through another apparatus according to the present invention.

FIG. 3 illustrates another form that the invention can take. The principal difference between the FIG. 3 structure and the FIG. 2 structure is the fact that in the FIG. 3 arrangement the tank liquid level 46 is maintained by a float switch 70, rather than by a weir. The partition 72 that separates overflow chamber or reservoir **44*a* from tank 10 is a full height partition that forms a complete barrier to liquid flow from tank 10 into reservoir 44*a***.

Float switch 70 is electrically connected to an electric actuator such as a motor or solenoid for a diverter valve 74. As the liquid level 46 tends to rise above the float switch setting, the float switch causes valve 74 to direct the recirculating liquid through a line 75 back into chamber **44*a*. In the event that the liquid level 46 should incrementally drop below the float switch setting the float switch will cause valve 74 to direct the recirculating liquid through line 78 into tank 10**.

Liquid level 46 is maintained at a substantially constant height a predetermined distance above the upper end of tube 42, such that a substantially uniform liquid velocity is maintained in the tube. The tube 42 velocity may be varied either by adjusting float switch 70 up or down, or adjusting tube 42 up or down in sleeve 45. With either type of adjustment the liquid head differential can be varied to thereby adjust the tube 42 flow rate.

The drawings necessarily show specific forms that the invention can take. However, it will be understood that the invention can be practiced in various forms.

What is claimed is:

1. An apparatus for uniformly quenching heated workpieces, comprising a liquid sump containing a quenching liquid therein; a flow tube provided in said sump; said flow tube having an open upper end adapted to receive said workpieces for downward motion through the tube; reservoir means surrounding said upper end of said flow tube for intercepting said quenching liquid flowing out of said flow tube; said flow tube having an open lower end communicating with the quenching liquid for enabling the quenching liquid to flow upwardly through the tube to extract heat from the downwardly moving workpieces, said open lower end forming a sole entry port for admitting said quenching liquid into said tube; means for maintaining the liquid level in the sump at a higher elevation than the upper end of the tube thereby producing a hydrostatic liquid head and a turbulant upflow of liquid in the tube; conveyor means provided in said sump for receiving and removing said workpieces upon exit of said workpieces from said lower end of said flow tube; and liquid pumping means for pumping said quenching liquid from said reservoir means into said liquid sump.

2. The apparatus of claim 1, wherein the upper end of the flow tube flares radially outwardly and upwardly.

3. The apparatus of claim 1, wherein the lower end portion of the tube flares outwardly and downwardly, such that the liquid is caused to accelerate gradually as it flows into the tube.

4. The apparatus of claim 1, wherein the lower end portion of the tube has a curved bell-shaped configuration for smooth guidance of the liquid into the tube.

5. The apparatus of claim 1, wherein said reservoir means is located in an upper portion of the liquid sump.

6. The apparatus of claim 1, wherein said means for maintaining liquid level comprises a weir interposed between the sump and the reservoir means, whereby excess liquid in the sump is caused to drain into the reservoir means.

7. The apparatus of claim 1, and further comprising a filter; a heat exchanger; a liquid pump for pumping liquid from said reservoir means through the filter and heat exchanger, and thence back into the sump; said means for maintaining the liquid level comprising a weir arranged to direct liquid from the sump into the reservoir means, such that the pumping rate of the liquid pump has no effect on the sump liquid level.

8. An apparatus for quenching heated steel parts, comprising an upright liquid tank having an open upper end; a quenching liquid contained within said tank; a liquid reservoir means that includes a floor located in an upper portion of the tank, and a vertical partition means extending upwardly from said floor within the tank, said vertical partition means having an upper edge area thereof constituting a weir for accommodating liquid flow from the tank into the reservoir means; a vertical tube extending downwardly through said floor, such that an upper portion of the tube is located within the reservoir means and a lower portion of the tube is located within the tank; said tube having an open upper end adapted to receive steel parts for downward motion through the tube; said tube having an open lower end communicating with the quenching liquid, whereby liquid is enabled to flow upwardly through the tube to extract heat from the downwardly moving parts, said open lower end forming a sole entry port for admitting said quenching liquid into said tube; said weir being located above the plane of the tube upper end, whereby a hydrostatic liquid head is established to provide the motive force for moving the quenching liquid upwardly through the tube in a turbulent upflow; and conveyor means provided in said sump for receiving and removing said workpieces upon exit of said workpieces from said lower end of said tube.

9. The apparatus of claim 8 and further comprising an overflow chamber means surrounding said vertical tube.

10. The apparatus of claim 9, and further comprising a liquid filter means and heat exchanger located between the pumping means and the tank.

11. The apparatus of claim 7, wherein said vertical partition means comprises a vertically adjustable wall; said vertically adjustable wall having an upper edge defining a vertically adjustable weir.

* * * * *